US006038959A

United States Patent [19]

Sawada

[11] Patent Number: 6,038,959

[45] Date of Patent: Mar. 21, 2000

[54] CYLINDER DEVICE FOR DISPLACING WORKPIECE

[75] Inventor: Takayuki Sawada, Toride, Japan

[73] Assignee: SMC Kabushiki Kaisha, Tokyo, Japan

[21] Appl. No.: 08/931,751

[22] Filed: Sep. 16, 1997

[30] Foreign Application Priority Data

Oct. 9, 1996 [JP] Japan ..... 8-268981

[51] Int. Cl.[7] ..... F01B 25/26

[52] U.S. Cl. ..... 92/5 R; 92/117 A; 92/107; 92/111; 92/164; 92/165 PR

[58] Field of Search ..... 92/5 R, 85 R, 92/117 R, 117 A, 107, 109, 110, 111, 163, 164, 165 R, 165 PR

[56] References Cited

U.S. PATENT DOCUMENTS

| | | | |
|---|---|---|---|
| D. 382,331 | 8/1997 | Iida et al. . | |
| D. 382,631 | 8/1997 | Iida et al. . | |
| 1,788,298 | 1/1931 | Hottel | 92/117 A |
| 2,841,117 | 7/1958 | Sewn | 92/111 |
| 3,465,650 | 9/1969 | Gluck | 92/85 R |
| 4,130,205 | 12/1978 | Luthi | 92/165 PR |
| 4,257,314 | 3/1981 | Deschner | 92/5 R |
| 4,896,584 | 1/1990 | Stoll et al. . | |
| 5,651,302 | 7/1997 | Mills | 92/117 R |
| 5,669,283 | 9/1997 | Iida et al. | 92/5 R |

FOREIGN PATENT DOCUMENTS

| | | |
|---|---|---|
| 38 20 373 C2 | 10/1993 | Germany . |
| 196 00 310 A1 | 7/1996 | Germany . |

*Primary Examiner*—Thomas E. Denion
*Attorney, Agent, or Firm*—Oblon, Spivak, McClelland, Maier & Neustadt, P.C.

[57] ABSTRACT

A cylinder device includes a casing with a pair of fluid inlet/outlet ports defined therein, a base plate, a piston fixed to the base plate, a cylinder, and a top plate. The cylinder device also has first, second, and third cylinder chambers defined in the cylinder between the base plate, the piston, and the top plate, a first fluid passage and a second fluid passage through which one of the fluid inlet/outlet ports communicates with the first and third cylinder chambers, and a third fluid passage and a fourth fluid passage through which the other fluid inlet/outlet port communicates with the second cylinder chamber.

18 Claims, 9 Drawing Sheets

CYLINDER DEVICE FOR DISPLACING WORKPIECE

BACKGROUND OF THE INVENTION

1. Field of the Invention

The present invention relates to a cylinder device disposed between feed lines, for example, for displacing a workpiece a predetermined distance.

2. Description of the Related Art

It has heretofore been customary for factories to have workpiece feed systems which comprise a plurality of feed conveyors or feed rollers. Such a workpiece feed system has a plurality of feed lines including first and second feed lines that extend perpendicularly to each other and a transfer unit disposed at the junction of the first and second feed lines for lifting a workpiece fed from the first feed line and transferring the lifted workpiece to the second feed line.

The present invention is concerned with an improvement in a cylinder device disclosed in U.S. patent application Ser. No. 08/582,911, which is used as a transfer unit and has a low profile for space-saving purpose.

SUMMARY OF THE INVENTION

It is a general object of the present invention to provide a cylinder device which is capable of producing an increased output power for displacing a workpiece.

A major object of the present invention is to provide a cylinder device which can handle an increased variety of workpieces with an increased output power for greater performance.

Another object of the present invention is to provide a cylinder device which is capable of dampening shocks produced when a piston or a cylinder reaches ends of the stroke of displacement thereof.

Still another object of the present invention is to provide a cylinder device which has a low profile or a reduced height or vertical dimension to allow effective utilization of a vertical space.

The above and other objects, features, and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
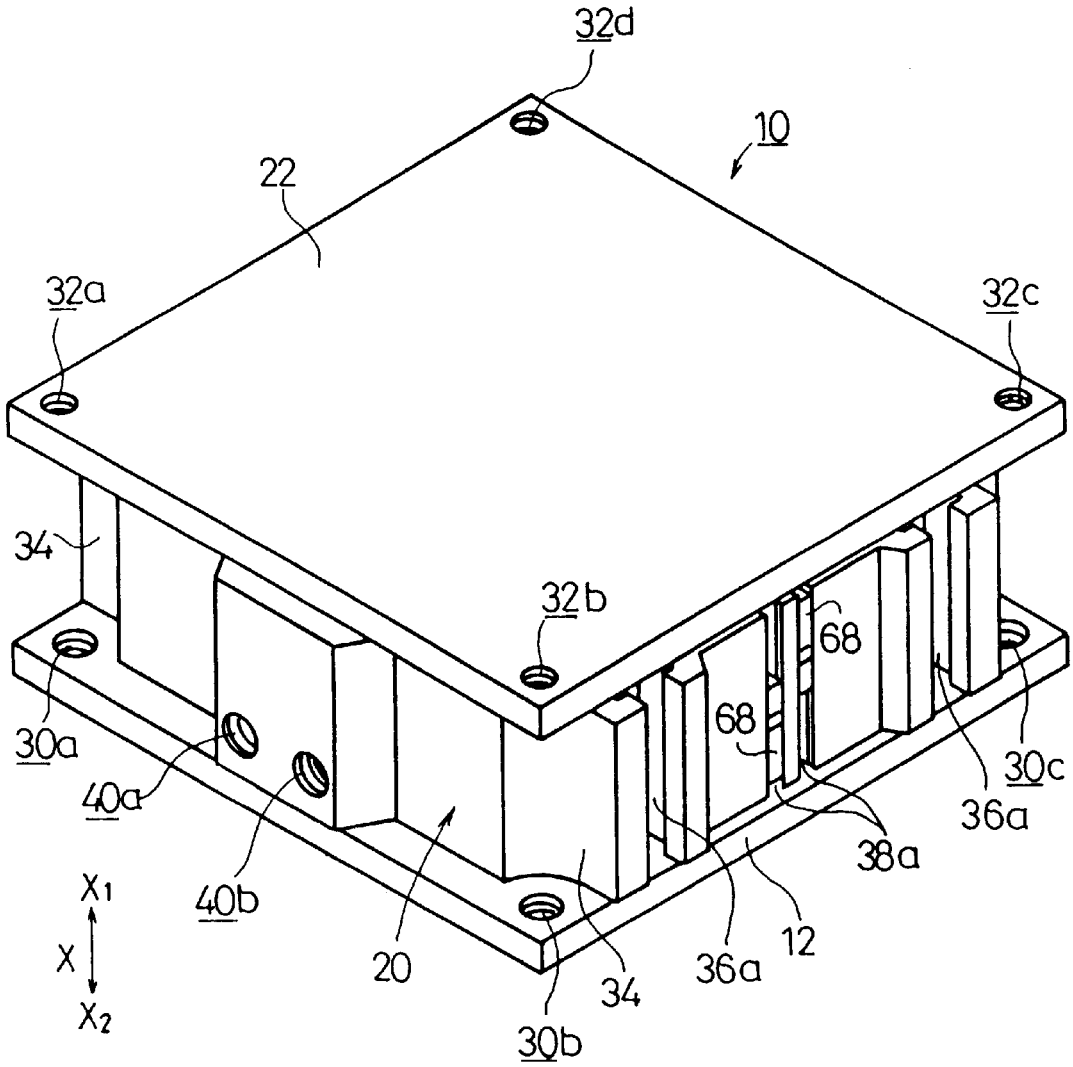
FIG. 1 is a perspective view of a cylinder device according to a first embodiment of the present invention.

As shown in FIG. 1, a cylinder device 10 according to a first embodiment of the present invention basically comprises a substantially square base plate 12, a casing 20 fastened to a stepped surface of the base plate 12 by four screws 14 (see FIG. 3) and having a through hole 16 (see FIGS. 4 and 5) of substantially circular cross section defined therein which receives a cylinder 18 for vertical movement therein, and a top plate 22 having a shape substantially which is the same as the shape of the base plate 12 and fixed to an upper end of the cylinder 18.

Figure 4:
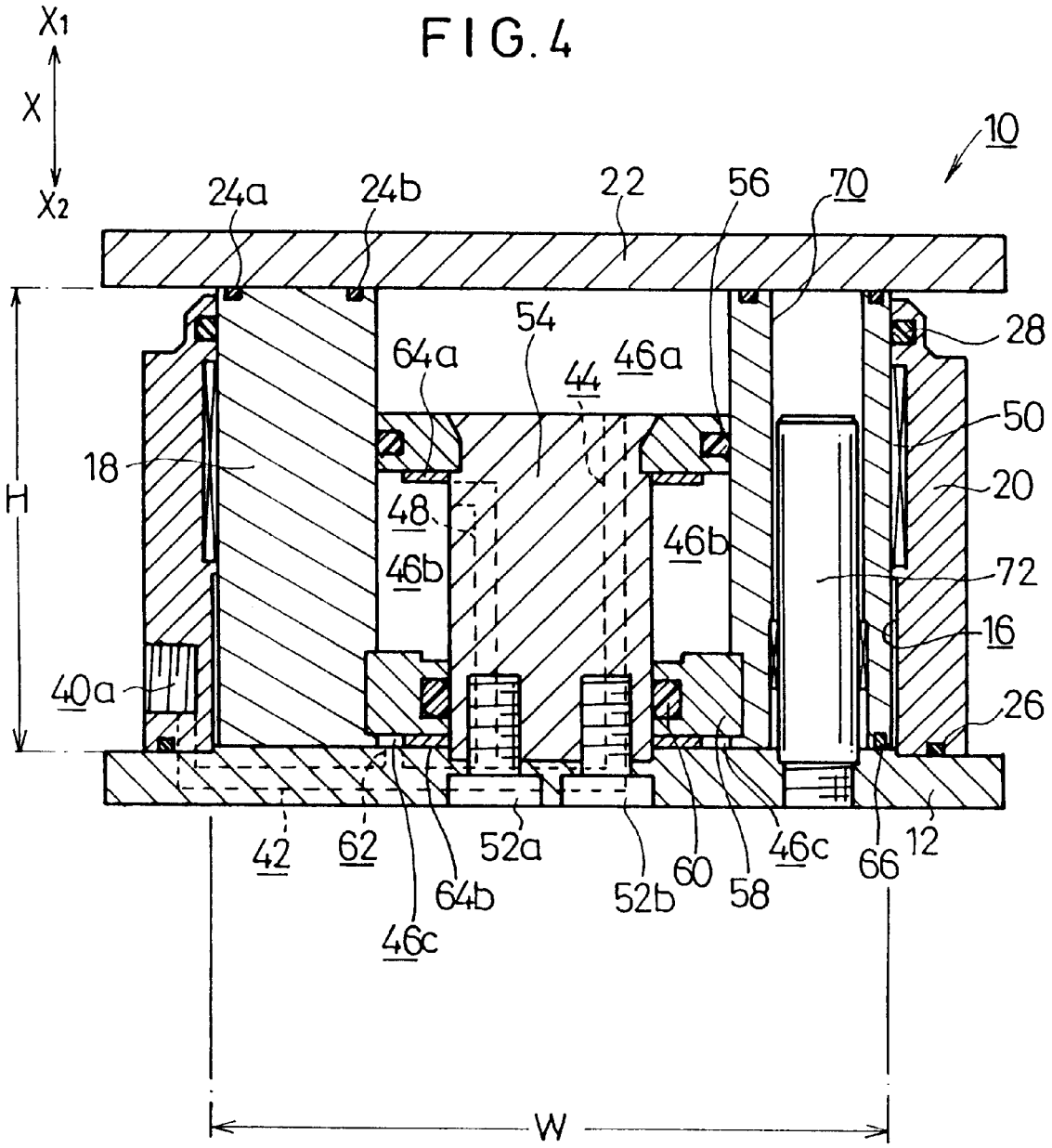
FIG. 4 is a vertical cross-sectional view taken along line IV—IV of FIG. 3.
Figure 5:
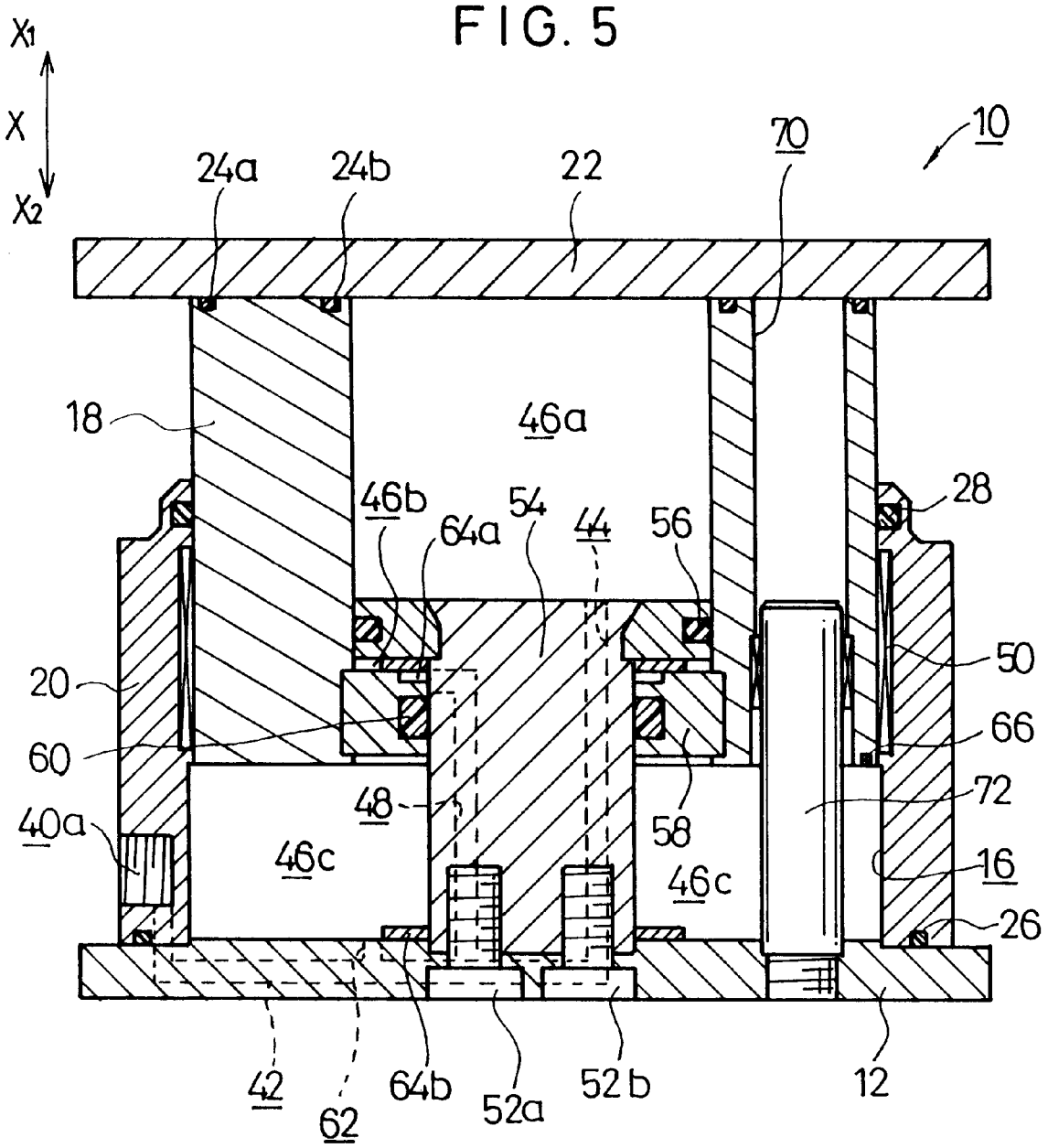
FIG. 5 is a vertical cross-sectional view of the cylinder device shown in FIG. 4, with the top plate thereof being elevated.

As shown in FIGS. 4 and 5, a pair of ring-shaped first gaskets 24*a*, 24*b* is disposed between joined surfaces of the top plate 22 and the cylinder 18. A ring-shaped second gasket 26 is disposed between joined surfaces of the base plate 12 and the casing 20. A ring-shaped third gasket 28 is disposed between sliding surfaces of the cylinder 18 and the casing 20, the ring-shaped third gasket 28 being received in an annular groove defined in the casing 20.

Figure 2:
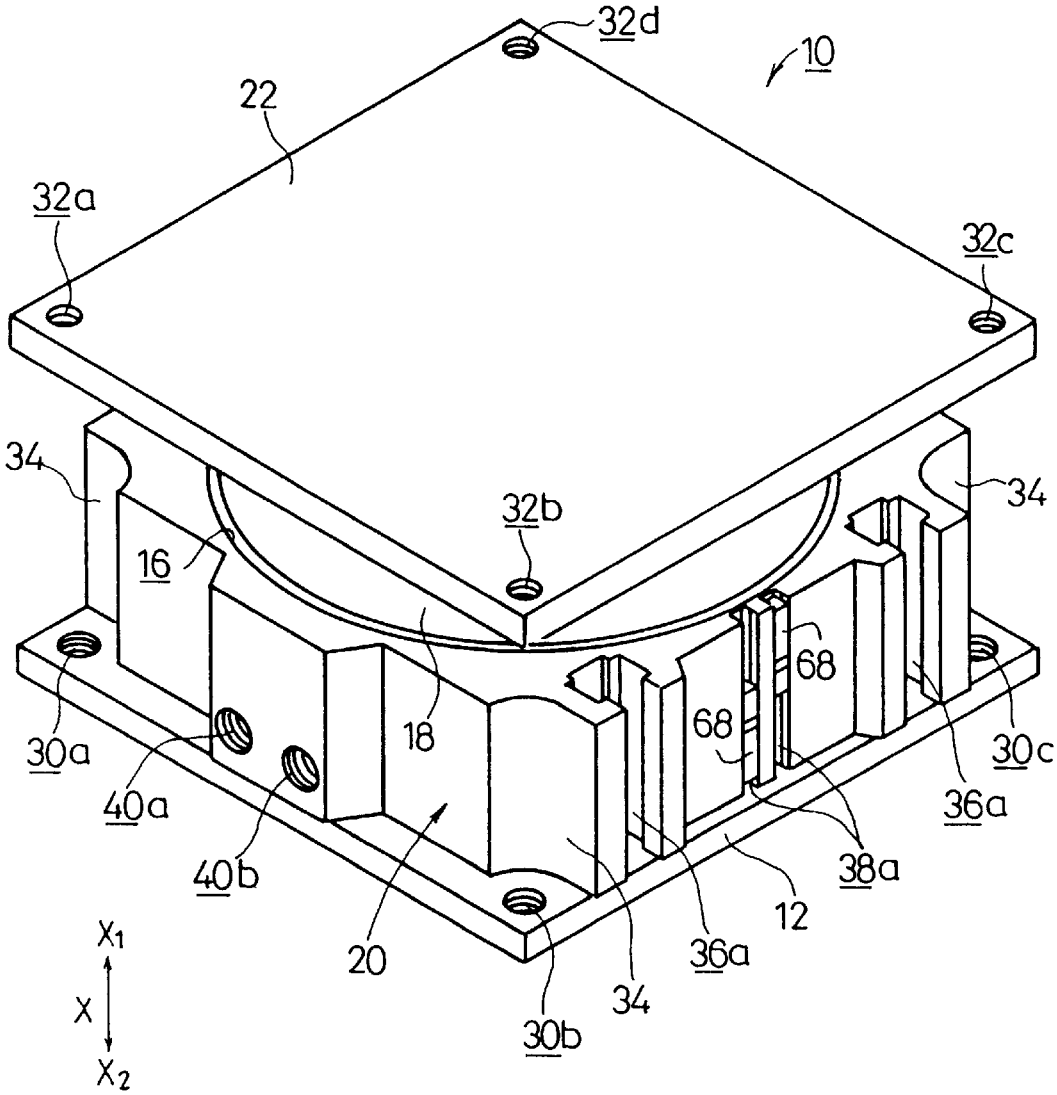
FIG. 2 is a perspective view of the cylinder device shown in FIG. 1, with a top plate thereof being elevated.

As shown in FIGS. 1 and 2, four threaded attachment holes 30*a*–30*d* are defined in respective four corners of the base plate 12, and four threaded attachment holes 32*a*–32*d* are defined in respective four corners of the top plate 22. The cylinder device 10 may be fastened to another device by screws threaded into the attachment holes 30*a*–30*d* in the base plate 12, and similarly may be fastened to another device by screws threaded into the attachment holes 32*a*–32*d* in the top plate 22. The casing 20 has its four corners 34 near the respective attachment holes 30*a*–30*d*, which are recessed as concave surfaces to expose the attachment holes 30*a*–30*d*.

The casing 20 also has three pairs of substantially parallel, spaced attachment grooves 36*a*, 36*b*, 36*c* (see FIG. 3) defined in respective three outer side surfaces thereof and each having a modified T-shaped cross section. The attachment grooves 36*a*, 36*b*, 36*c* extend in the directions indicated by the arrow X (see FIG. 1), i.e., the direction perpendicular to the base and top plates 12, 22. The casing 20 also has three pairs of substantially parallel sensor attachment grooves 38*a*, 38*b*, 38*c* defined in the respective three outer side surfaces thereof and extending in the directions indicated by the arrow X. The pair of sensor attachment grooves 38*a* is positioned intermediate between the attachment grooves 36*a*, the pair of sensor attachment grooves 38*b* intermediate between the attachment grooves 36*b*, and the pair of sensor attachment grooves 38*c* intermediate between the attachment grooves 36*c*.

The cylinder device 10 can horizontally be supported by headed retainers (not shown) fitted in the respective attachment grooves 36*a*, 36*b*, 36*c*, the headed retainers being shaped complementarily to the attachment grooves 36*a*, 36*b*, 36*c*. Since the attachment grooves 36*a*, 36*b*, 36*c* extend in the directions indicated by the arrow X, the headed retainers can be adjusted in their vertical positions along the attachment grooves 36*a*, 36*b*, 36*c*.

Figure 3:
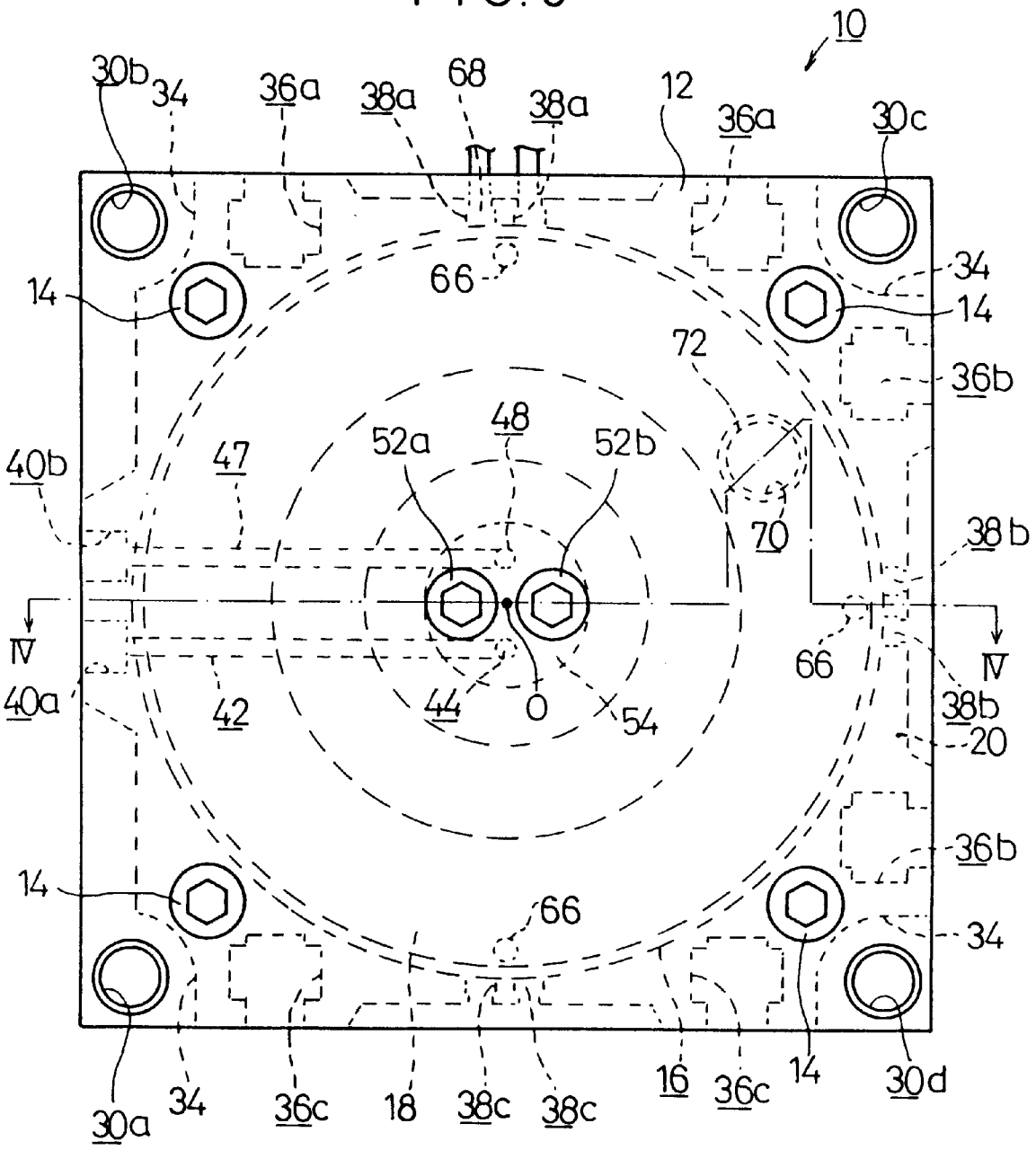
FIG. 3 is a bottom view of the cylinder device shown in FIG. 1.

The casing 20 has a pair of fluid inlet/outlet ports 40*a*, 40*b* defined in an outer side surface thereof other than the other three outer side surfaces where the attachment grooves 36*a*–36*c*, 38*a*–38*c* are defined. As shown in FIGS. 3 and 4, the fluid inlet/outlet port 40*a* communicates with first and third cylinder chambers 46*a*, 46*c* (described later on) through a first fluid passage 42 defined in the base plate 12 and a second fluid passage 44 branched from the first fluid passage 42.

The other fluid inlet/outlet port 40*b* communicates with a second cylinder chamber 46*b* (described later on) through a third fluid passage 47 defined in the base plate 12 and a fourth fluid passage 48 branched from the third fluid passage 47. A cylindrical bushing (guide member) 50 made of synthetic resin or the like is coaxially fitted in an inner wall surface of the through hole 16 of circular cross section that is defined in the casing 20.

The first and second fluid passages 42, 44 serve as a first communication passageway, and the third and fourth fluid passages 47, 48 as a second communication passageway.

A piston 54 is fixedly mounted substantially centrally on the base plate 12, i.e., centrally in the casing 20, by screws 52*a*, 52*b*. The piston 54 is disposed in a large-diameter hole defined in the cylinder 18 and extending axially in the directions indicated by the arrow X. The piston 54 has a larger-diameter end portion on which there is mounted a seal ring 56 that is received in an annular groove defined in an outer circumferential edge of the larger-diameter end portion. The cylinder 18, which is of a substantially cylindrical shape, slidably disposed in the through hole 16 for sliding movement guided by the bushing 50. The large-diameter hole defined in the cylinder 18 is divided into the first cylinder chamber 46*a* and the second cylinder chamber 46*b* by the larger-diameter end portion of the piston 54 and the seal ring 56.

The first cylinder chamber 46*a* communicates with the fluid inlet/outlet port 40*a* through the first fluid passage 42 defined in the base plate 12 and the second fluid passage 44 that is defined axially in the piston 54. The second cylinder chamber 46*b* communicates with the fluid inlet/outlet port 40*b* through the third fluid passage 47 defined in the base plate 12 and the fourth fluid passage 48 that is defined axially in the piston 54.

A rod cover 58 is secured by staking to a lower end of the cylinder 18 in surrounding relation to the piston 54 for displacement in unison with the cylinder 18. An O-ring 60 is fitted in an annular groove defined in an inner circumferential surface of the rod cover 58 which is held in sliding contact with the piston 54. The third cylinder chamber 46*c* is defined below the rod cover 58 and surrounded by the cylinder 18, the rod cover 58, the piston 54, and the base plate 12. The third cylinder chamber 46*c* is held in communication with the fluid inlet/outlet port 40*a* through a communication passageway 62 that is branched from the first fluid passage 42 defined in the base plate 12. The first cylinder chamber 46*a* serves as a chamber defined between the top plate 22 and a piston-head end of the piston 54, and the second cylinder chamber 46*b* and the third cylinder chamber 46*c* serve as chambers defined between the base plate 12 and a piston-rod end of the piston 54.

The fluid inlet/outlet port 40*a* communicates with the first cylinder chamber 46*a* and the third cylinder chamber 46*c* through the first fluid passage 42, the second fluid passage 44, and the communication passageway 62, and the other fluid inlet/outlet port 40*b* communicates with the second cylinder chamber 46*b* through the third fluid passage 47 and the fourth fluid passage 48. The first, second, and third gaskets 24*a*, 24*b*, 26, 28, the seal ring 56, and the O-ring 60 serve as sealing means for hermetically sealing the first, second, and third cylinder chambers 46*a*, 46*b*, 46*c*.

As illustrated in FIG. 4, the cylinder 18 has a width W greater than a height H thereof. The cylinder 18 can be lifted in the direction indicated by the arrow $X_1$ by a fluid under pressure introduced into the first cylinder chamber 46*a* and the third cylinder chamber 46*c* as shown in FIG. 5, and lowered in the direction indicated by the arrow $X_2$ by a fluid under pressure introduced into the second cylinder chamber 46*b* as shown in FIG. 4.

Two axially spaced ring-shaped dampers 64*a*, 64*b* are mounted on the piston 54 respective at the larger-diameter end portion thereof and at the base plate 12. When the piston 54 is lifted and lowered, the rod cover 58 abuts against the dampers 64*a*, 64*b* to dampen shocks and reduced noise at ends of the stroke of displacement of the piston 54. The rod cover 58 serves as a stop at the stroke end of upper movement of the cylinder 18 when engaging the larger-diameter end portion of the piston 54.

As can be seen from FIG. 3, the piston 54, the rod cover 58, and the cylinder 18 are coaxial with each other around a point O where the diagonal lines of the substantially square base plate 12 intersect with each other.

Magnets 66 (see FIGS. 3 through 5) are supported on or closely to an outer circumferential surface of the cylinder 18 near the sensor attachment grooves 38*a*, 38*b*, 38*c* defined in the casing 20. Sensors 66 (see FIGS. 1 through 3) held in the sensor attachment grooves 38*a*, 38*b*, 38*c* at given positions act magnetically with the magnets 66 to detect the vertical position of the cylinder 18 with respect to the casing 20. The cylinder 18 has a vertical guide hole 70 (see FIGS. 3 and 4) defined therein and spaced a predetermined distance from the point O, and a guide rod (rotation prevention means) 72 fixed to the base plate 12 is slidably inserted in the guide hole 70. The guide rod 72 serves to prevent the cylinder 18 from rotating with respect to the casing 20 and also to guide the cylinder 18 to move with respect to the casing 20. The guide hole 70 and the guide rod 72 may be dispensed with if the outer surface of the cylinder 18 and the inner surface of the casing 20 are not cylindrical, but angular, in shape.

Operation and advantages of the cylinder device 10 according to the first embodiment will be described below.

Figure 6:
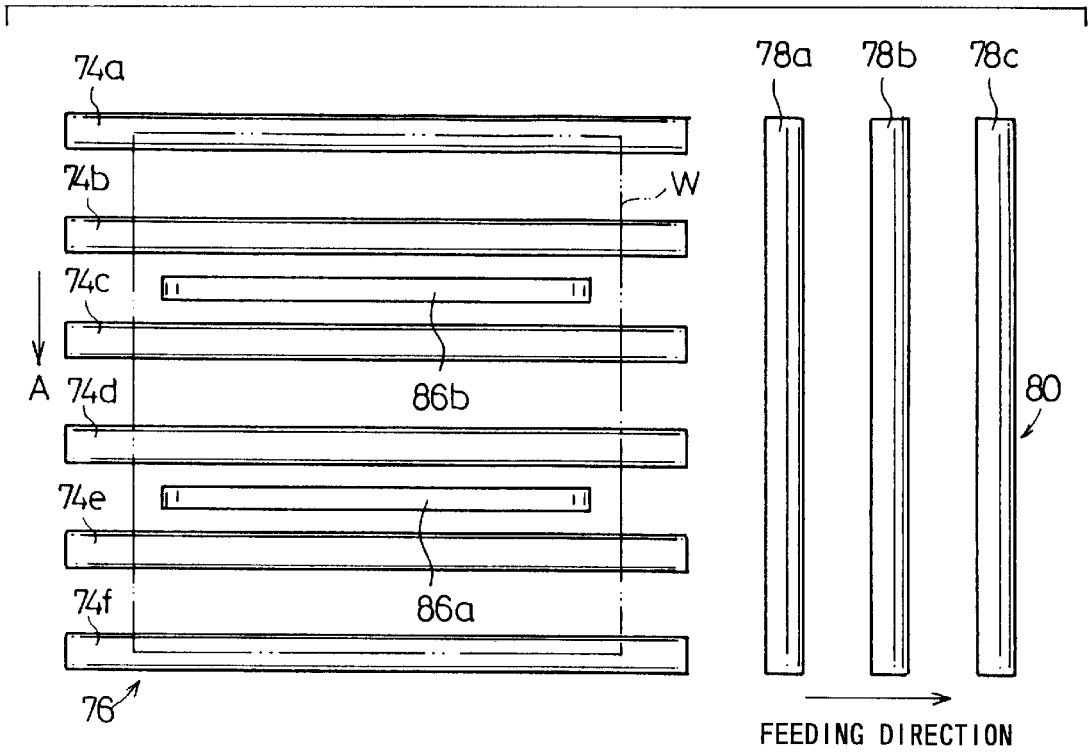
FIG. 6 is a plan view of a workpiece feed system which incorporates the cylinder device shown in FIG. 1 that is disposed at the junction of first and second feed lines.

As shown in FIG. 6, a workpiece feed system which incorporates the cylinder device 10 has a first feed line 76 which comprises a plurality of substantially parallel feed rollers 74*a*–74*f* that can be rotated about their own axes by a driver source (not shown), and a second feed line 80 which comprises a plurality of substantially parallel feed rollers 78*a*–78*c* extending substantially perpendicularly to the feed rollers 74*a*–74*f* and rotatable about their own axes by a driver source (not shown) for feeding a workpiece in a direction substantially perpendicular to the first feed line 76.

Figure 7:
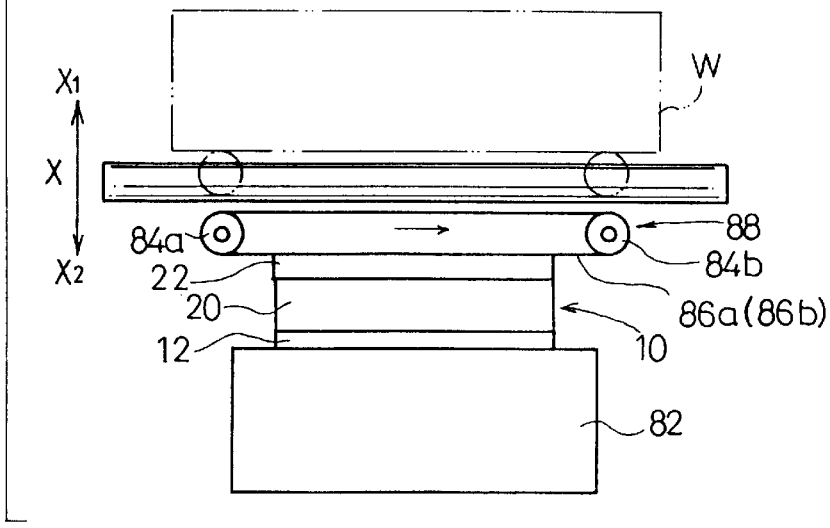
FIG. 7 is a front elevational view of the cylinder device that is incorporated in the workpiece feed system shown in FIG. 6.

The cylinder device 10 is fixedly mounted on a base 82 (see FIG. 7) below the first feed line 76 by screws threaded in the attachment holes 30*a*–30*d*. The top plate 22 of the cylinder device 10 supports thereon a workpiece feeder 88 that comprises a pair of substantially parallel feed belts 86*a*, 86*b* trained around guide rollers 84*a*, 84*b*. The feed belts 86*a*, 86*b* can be moved in a circulatory manner in the direction indicated by the arrow (FIG. 7) by a drive source (not shown) operatively coupled to the guide rollers 84*a*, 84*b*. The feed belts 86*a*, 86*b* extend substantially parallel to the feed rollers 74*a*–74*f*, and are positioned between the feed rollers 74*b*, 74*c* and between the feed rollers 74*d*, 74*e*. The fluid inlet/outlet ports 40*a*, 40*b* are connected to a pressurized fluid source (not shown) through tubes or the like.

After the above preparatory process, a workpiece W is fed in the direction indicated by the arrow A (FIG. 6) and detected by a detector (not shown) when it reaches a predetermined position above the feed belts 86*a,* 86*b.* In response to an output signal from the detector, a directional control valve (not shown) is operated to supply the fluid inlet/outlet port 40*a* with a fluid under pressure, e.g., air under pressure, from the pressurized fluid source. At the same time, the other fluid inlet/outlet port 40*b* is vented to the atmosphere by the directional control valve.

The fluid under pressure supplied to the fluid inlet/outlet port 40*a* flows through the first and second fluid passages 42, 44 into the first cylinder chamber 46*a,* where there is developed a pressure buildup that moves the top plate 22 in the direction indicated by the arrow $X_1$. The fluid under pressure supplied to the fluid inlet/outlet port 40*a* is also introduced through the communication passageway 62 into the third cylinder chamber 46*c* substantially at the same time that the fluid under pressure is introduced into the first cylinder chamber 46*a.* Therefore, the cylinder 18 is also moved in the direction indicated by the arrow $X_1$ under a pressure buildup developed in the third cylinder chamber 46*c.*

Since the fluid under pressure supplied to the fluid inlet/outlet port 40*a* is also introduced through the communication passageway 62 into the third cylinder chamber 46*c* substantially at the same time that the fluid under pressure is introduced into the first cylinder chamber 46*a,* the pressure-bearing area in the first cylinder chamber 46*a* and the pressure-bearing area in the third cylinder chamber 46*c* are combined to bear the pressure of the fluid introduced into the cylinder device 10. Consequently, the cylinder device 10 can produce an increased output power for lifting the top plate 22.

The top plate 22 is elevated together with the cylinder 18 in the direction indicated by the arrow $X_1$ while being guided by the guide rod 72, until it reaches an end of its stroke of displacement when the rod cover 58 engages the larger-diameter end portion of the piston 54 as shown in FIG. 5. At this time, inasmuch as the rod cover 58 abuts against the damper 64*a,* shocks are dampened and not large noise is generated.

The feeder 88 is also lifted in unison with the top plate 22 in the direction indicated by the arrow $X_1$. The feed belts 86*a,* 86*b* project upwardly between the feed rollers 74*b,* 74*c* and between the feed rollers 74*d,* 74*e,* as indicated by the two-dot-and-dash lines in FIG. 7. The workpiece W is lifted a certain distance off the feed rollers 74*a*–74*f* and is supported by the feed belts 86*a,* 86*b.* The feed belts 86*a,* 86*b* are then moved to transfer the workpiece W onto the second feed line 80 perpendicular to the first feed line 76, after which the workpiece W is fed to a desired position by the second feed line 80.

After the workpiece W has been transferred onto the second feed line 80, the directional control valve is operated to supply the fluid under pressure to the other fluid inlet/outlet port 40*b,* from which it is introduced through the third and fourth fluid passages 47, 48 into the second cylinder chamber 46*b.* The top plate 22 is now lowered in unison with the cylinder 18 in the direction indicated by the arrow $X_2$ until it returns to its original position as shown in FIG. 4. At this time, the fluid inlet/outlet port 40*a* is vented to the atmosphere by the directional control valve.

According to the first embodiment, as described above, the fluid under pressure supplied to the fluid inlet/outlet port 40*a* is also introduced through the communication passageway 62 into the third cylinder chamber 46*c* substantially at the same time that the fluid under pressure is introduced into the first cylinder chamber 46*a,* so that the pressure-bearing area in the first cylinder chamber 46*a* and the pressure-bearing area in the third cylinder chamber 46*c* are combined to bear the pressure of the fluid introduced into the cylinder device 10. As a result, the cylinder device 10 can produce an increased output power for lifting the top plate 22 and hence can lift heavy workpieces W. Because the cylinder device 10 can produce an increased output power, it exhibits increased performance or an increased workpiece lifting capability for handling an increased range of workpieces S.

Furthermore, inasmuch as the height H of the cylinder 18 is small relatively to the width W thereof, the cylinder device 10 has a relatively low profile or small vertical dimension for effective utilization of a vertical space. The cylinder device 10 can thus be used in limited vertical spaces with large freedom.

Figure 8:
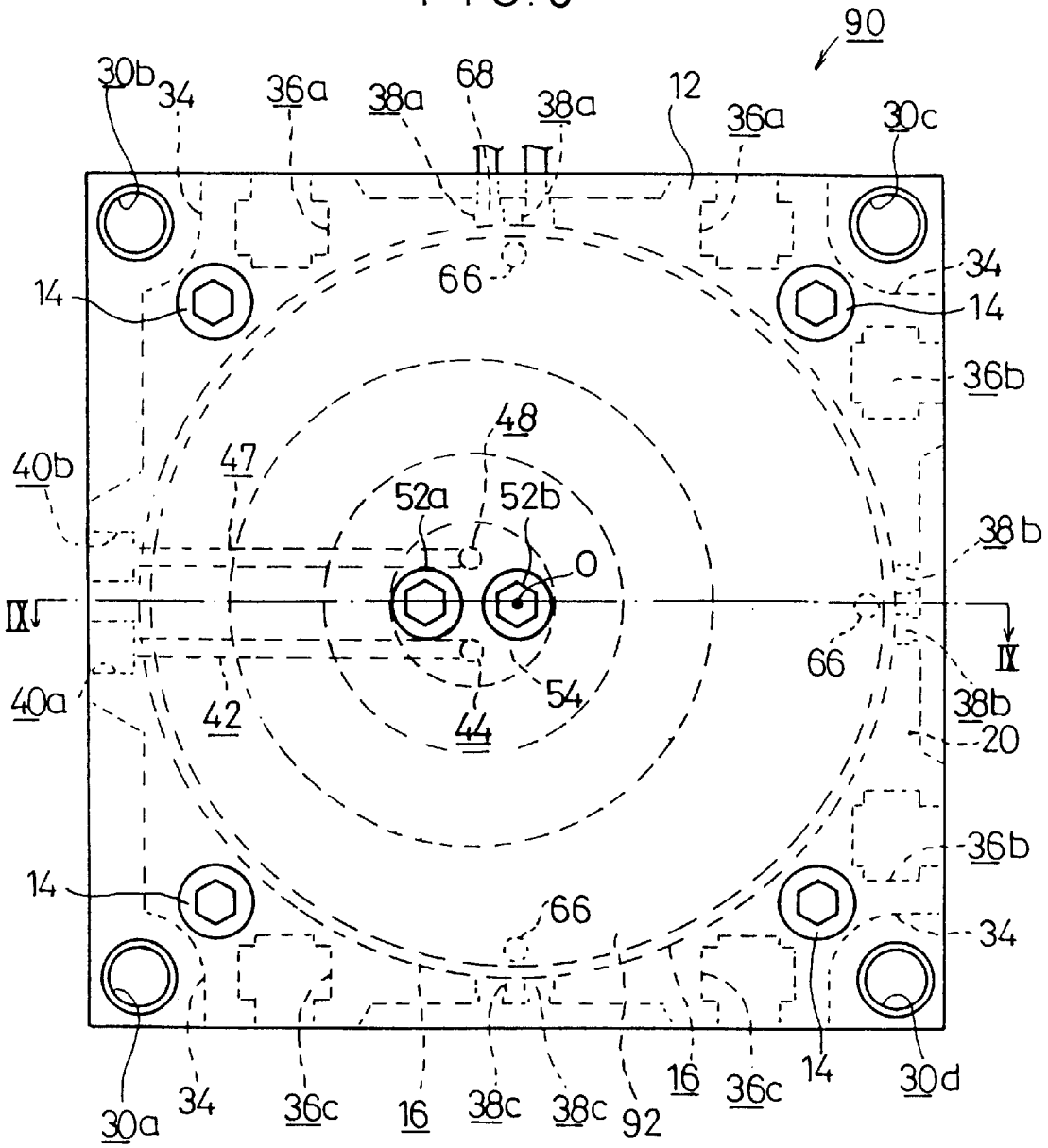
FIG. 8 is a perspective view of a cylinder device according to a second embodiment of the present invention.
Figure 9:
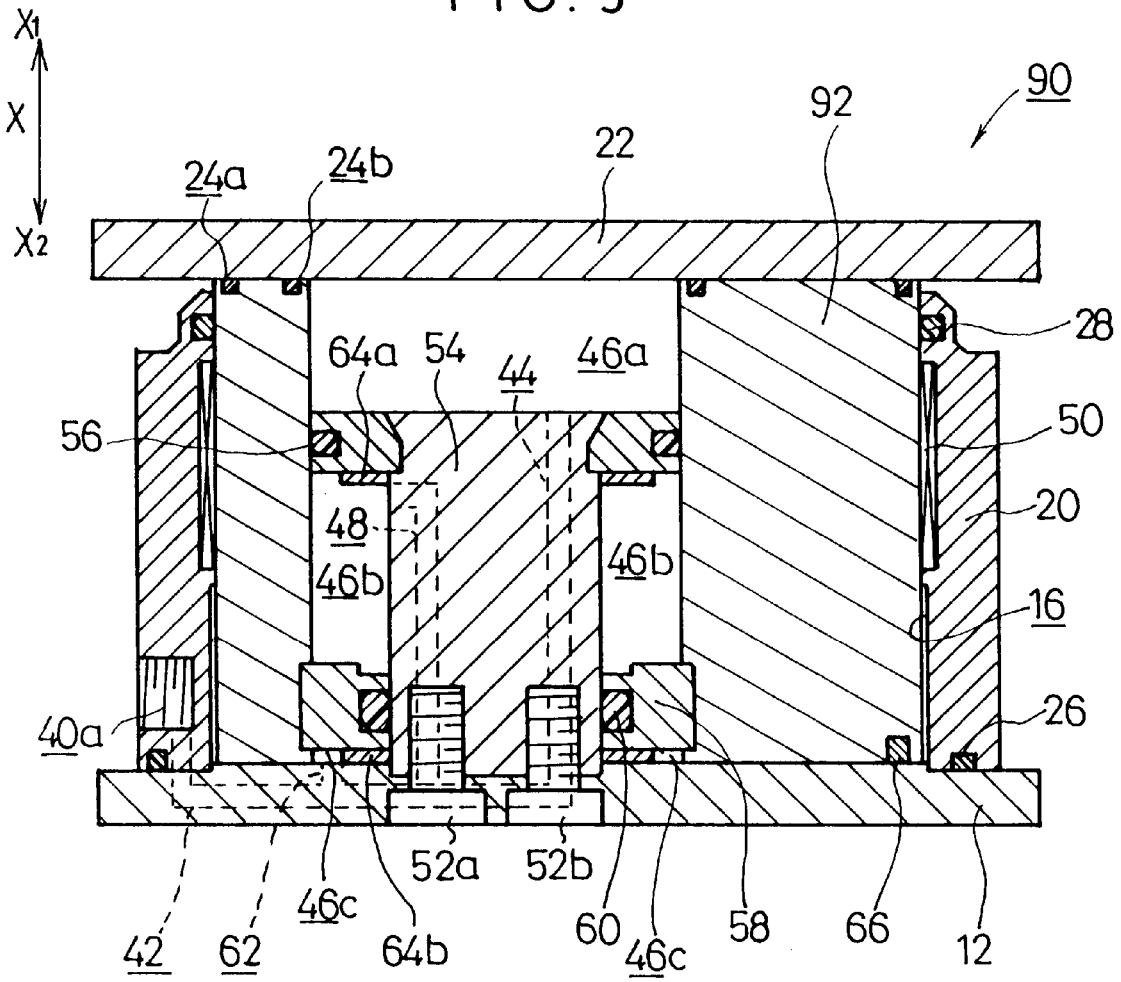
FIG. 9 is a vertical cross-sectional view taken along line IX—IX of FIG. 8.
Figure 10:
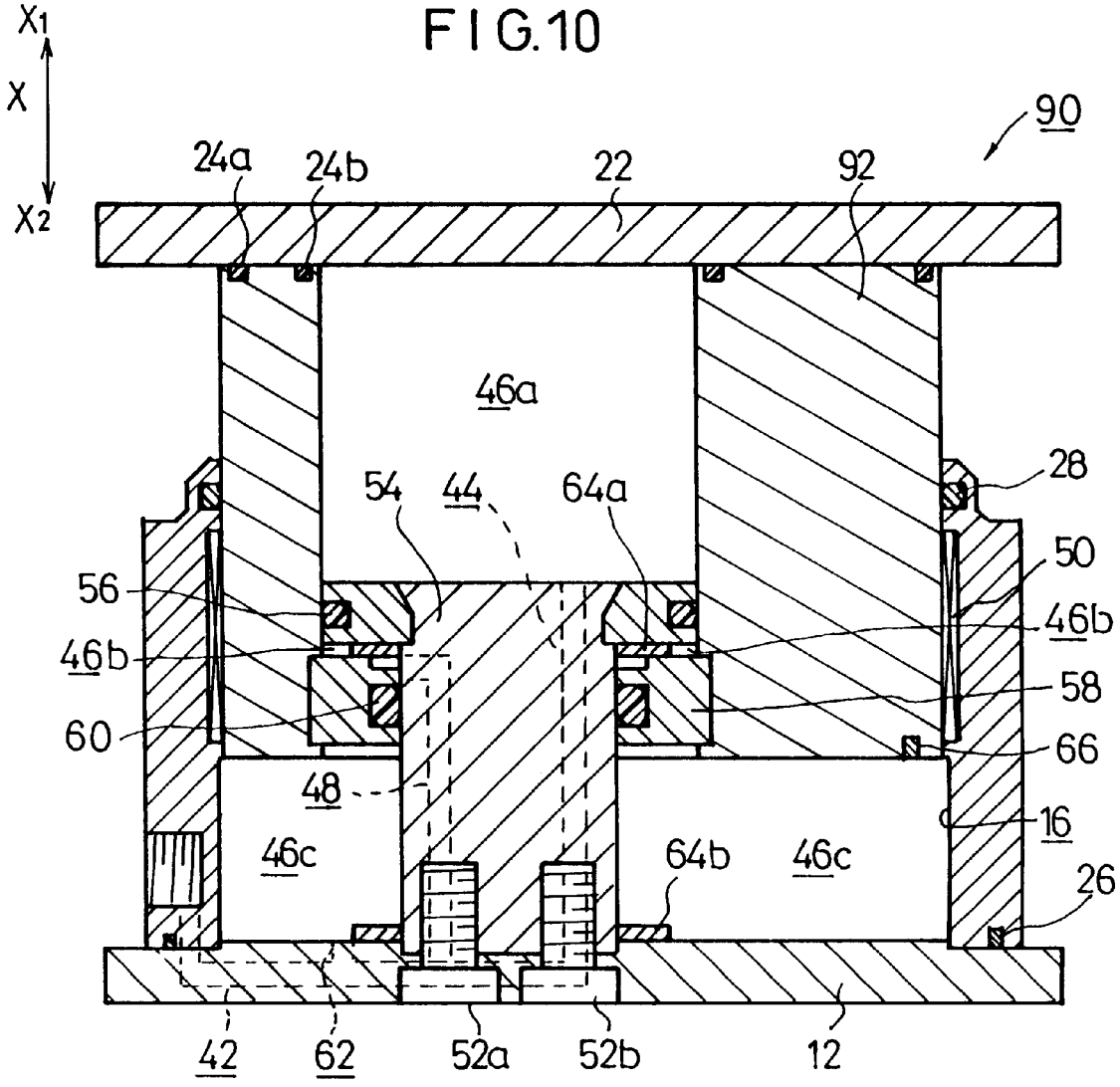
FIG. 10 is a vertical cross-sectional view of the cylinder device shown in FIG. 9, with a top plate thereof being elevated.

FIGS. 8 through 10 show a cylinder device 90 according to a second embodiment of the present invention. Those parts shown in FIGS. 8 through 10 which are identical to those shown in FIGS. 1 through 7 are denoted by identical reference numerals, and will not be described in detail below.

As shown in FIG. 8, the cylinder device 90 differs from the cylinder device 10 in that the piston 54 is positioned such that its central axis is displaced eccentrically from the point O, and no guide rod is used to prevent a cylinder 92 from rotating with respect to the casing 20. Other structural details of the cylinder device 90 are the same as those of the cylinder device 10.

In the first and second embodiments, the cylinder 18 (92) is vertically displaced with respect to the piston 54 fixedly mounted on the base plate 12. However, the base plate 12 may be oriented such that its plane extends vertically to displace the cylinder 18 (92) horizontally with respect to the piston 54 fixedly mounted on the base plate 12.

Although certain preferred embodiments of the present invention has been shown and described in detail, it should be understood that various changes and modifications may be made therein without departing from the scope of the appended claims.

What is claimed is:

1. A cylinder device comprising:

a base plate having a fluid passage defined therein;

a casing fixedly mounted on said base plate and having a fluid inlet/outlet port defined therein and a through hole defined therein, said fluid inlet/outlet port communicating respectively with said fluid passage;

a piston fixed to said base plate;

a cylinder reciprocally movably disposed in said through hole, said cylinder defining a plurality of chambers at piston-head and piston-rod ends of said piston;

a top plate fixed to said cylinder for displacement in unison with the cylinder;

a first branch passage defined in said piston and communicating at one end thereof with said fluid passage, and opening at another end thereof into one of the plurality of chambers at a piston-bead end of said piston;

a second branch passage defined in said base plate and communicating at one end thereof with said fluid passage, and opening at another end thereof into another of the plurality of chambers at a piston-rod end of said piston; and the arrangement being such that when a fluid under pressure is supplied through said fluid inlet/outlet port, through said fluid passage and through said first and second branch passages substantially simultaneously into said plurality of chambers, a fluid pressure buildup is developed simultaneously in said plurality of chambers to displace said cylinder and said top plate with respect to said piston.

2. A cylinder device according to claim 1, further comprising seal means for hermetically sealing said chambers.

3. A cylinder device according to claim 1, wherein said plurality of chambers comprises a space surrounded by said top plate, said cylinder, and a larger-diameter portion of said piston at the piston-head end thereof, and a space surrounded by a rod cover coupled to said cylinder, said cylinder, and said base plate.

4. A cylinder device according to claim 1, further comprising a guide member held in sliding contact with an outer circumference surface of said cylinder for guiding reciprocating movement of said cylinder.

5. A cylinder device according to claim 1, wherein said cylinder has rotation prevention means for preventing said cylinder from rotating when said cylinder reciprocally moves axially of said piston.

6. A cylinder device according to claim 5, wherein said rotation prevention means comprises a guide rod fixed to said base plate and a hole defined in said cylinder, said guide rod being slidably disposed in said hole.

7. A cylinder device according to claim 5, wherein said rotation prevention means comprises the piston fixed to said base plate eccentrically with respect to said cylinder.

8. A cylinder device according to claim 1, further comprising a rod cover coupled to said cylinder, a damper mounted on said piston for engagement with said rod cover at an end thereof, and a damper mounted on said piston for engagement with said rod cover at said base plate.

9. A cylinder device according to claim 1, further comprising a plurality of magnets mounted on or closely to an outer circumferential surface of said cylinder, said casing having a plurality of sensor attachment grooves defined in an outer circumferential surface thereof, and further comprising a plurality of sensors mounted respectively in said sensor attachment grooves for magnetically detecting said magnets movable in unison with said cylinder to detect a position of said cylinder based on a signal produced by said sensors.

10. A cylinder device comprising:

a base plate having first and second fluid passages defined therein;

a casing fixedly mounted on said base plate and having a pair of fluid inlet/outlet ports defined therein and a through hole defined therein, said pair of fluid inlet/outlet ports communicating respectively with said first and second fluid passages;

a piston fixed to said base plate;

a cylinder reciprocally movably disposed in said through hole, said cylinder defining first, second and third chambers at piston-head and piston-rod ends of said piston;

a top plate fixed to said cylinder for displacement in unison with the cylinder;

a first branch passage communicating at one end thereof with said first fluid passage, and opening at another end thereof into said first cylinder chamber for providing communication between one of said fluid inlet/outlet ports and said first cylinder chamber;

a second branch passage communicating at one end thereof with said first fluid passage, and opening at another end thereof into said third cylinder chamber for providing communication between said one of the fluid inlet/outlet ports and said third cylinder chamber; and a third branch passage communicating at one end thereof with said second fluid passage, and opening at another end thereof into said second cylinder chamber for providing communication between the other fluid inlet/outlet port and said second cylinder chamber;

the arrangement being such that when a fluid under pressure is introduced through said first fluid passage and through said first and second branch passages substantially simultaneously into said first cylinder chamber and said third cylinder chamber, a fluid pressure buildup is developed simultaneously in said first cylinder chamber and said third cylinder chamber to displace said cylinder and said top plate with respect to said piston, and when said fluid under pressure is introduced through said second fluid passage and through said third branch passage into said second cylinder chamber, a fluid pressure is developed in said second cylinder chamber to displace said cylinder and said top plate with respect to said piston.

11. A cylinder device according to claim 10, further comprising seal means for hermetically sealing said first, second, and third chambers.

12. A cylinder device according to claim 10, wherein said first chamber comprises a space surrounded by said top plate, said cylinder, and a larger-diameter portion of said piston at the piston-head end thereof, said second chamber comprises a space surrounded by a rod cover coupled to said cylinder, said cylinder, and said piston, and said third chamber comprises a space surrounded by said rod cover, aid cylinder, and said base plate.

13. A cylinder device according to claim 10, further comprising a guide member held in sliding contact with an outer circumference surface of said cylinder for guiding reciprocating movement of said cylinder.

14. A cylinder device according to claim 10, wherein said cylinder has rotation prevention means for preventing said cylinder from rotating when said cylinder reciprocally moves axially of said piston.

15. A cylinder device according to claim 14, wherein said rotation prevention means comprises a guide rod fixed to said base plate and a hole defined in said cylinder, said guide rod being slidably disposed in said hole.

16. A cylinder device according to claim 14, wherein said rotation prevention means comprises the piston fixed to said base plate eccentrically with respect to said cylinder.

17. A cylinder device according to claim 10, further comprising a rod cover coupled to said cylinder, a damper mounted on said piston for engagement with said rod cover at an end thereof, and a damper mounted on said piston for engagement with said rod cover at said base plate.

18. A cylinder device according to claim 10, further comprising a plurality of magnets mounted on or closely to an outer circumferential surface of said cylinder, said casing having a plurality of sensor attachment grooves defined in an outer circumferential surface thereof, and further comprising a plurality of sensors mounted respectively in said sensor attachment grooves for magnetically detecting said magnets movable in unison with said cylinder to detect a position of said cylinder based on a signal produced by said sensors.

* * * * *